US005495495A

United States Patent [19]

Cullan

[11] Patent Number: 5,495,495

[45] Date of Patent: Feb. 27, 1996

[54] DENSE LINING FOR CORELESS INDUCTION FURNACE

[75] Inventor: Gerard M. Cullan, Webster, Mass.

[73] Assignee: Saint-Gobain/Norton Industrial Ceramics Corporation, Worcester, Mass.

[21] Appl. No.: 450,096

[22] Filed: May 25, 1995

[51] Int. Cl.[6] ..... H05B 6/22

[52] U.S. Cl. ..... 373/155; 373/151

[58] Field of Search ..... 373/137, 151, 373/152, 155, 161, 162; 266/236

[56] References Cited

U.S. PATENT DOCUMENTS

| | | | |
|---|---|---|---|
| 3,708,600 | 1/1973 | Nickel et al. | 373/155 |
| 3,836,613 | 9/1974 | Granitzki et al. . | |
| 3,914,527 | 10/1975 | Osterholtz et al. | 373/155 |
| 4,142,063 | 2/1979 | Boniort et al. | 373/140 |
| 4,475,721 | 10/1984 | Pamart | 266/236 |
| 5,134,629 | 7/1992 | Cullan | 373/162 |
| 5,272,720 | 12/1993 | Cignetti et al. | 373/155 |

FOREIGN PATENT DOCUMENTS 069094 5/1993 European Pat. Off. .

*Primary Examiner*—Tu Hoang
*Attorney, Agent, or Firm*—Thomas M. DiMauro

[57] ABSTRACT

This invention relates to a refractory lining for use in a coreless induction furnace having a refractory crucible, wherein the refractory lining lines the inner surface of the refractory crucible and has a porosity of between 0.2% and 1%.

16 Claims, 2 Drawing Sheets

DENSE LINING FOR CORELESS INDUCTION FURNACE

BACKGROUND OF THE INVENTION

Using high frequency alternating electric current to melt certain metals is well known in the art. One type of furnace used in such procedures is the coreless induction furnace. See FIG. 1. The coreless induction furnace is characterized by a water cooled helical copper coil C that carries alternating current and is encased in ceramic grout G. This coil is wound around the outside of a cylindrical crucible R which holds a solid metal charge M. When the high frequency current flows within the coil, its resulting magnetic field induces an electric current in the metal charge. The metal charge's inherent resistance to that current causes the temperature of the metal charge to rise, eventually rendering it molten.

The conventional crucible of a coreless induction furnace typically comprises a protective refractory layer set in place by ramming dry refractory grain mixes (such as mullite-bonded alumina, spinel-bonded alumina and spinel-bonded magnesia) into place between a metal former and the ceramic grout. When rammed into place, these refractory mixes typically have a porosity of about 18% and a mean pore radius of about 10 um. If the rammed refractory remained in this state, its high porosity and large pore size would provide little or no resistance to molten metal. However, during furnace start-up (i.e., shortly before and during metal former meltdown), the rising temperature of the metal former gives off enough heat to cause the refractory grains at the metal/grain interface to bond together, resulting in a more dense ceramic surface layer (or "skin") having a porosity of about 10% and a pore size of about 8 microns (um) backed by unbonded refractory grains. This denser surface layer provides resistance against metal migration into the refractory. In addition, the porous nature of the remaining unbonded refractory grains not only provides a thermal expansion cushion for the denser surface layer when the denser surface layer contacts molten metal, it also provides an additional barrier against further molten metal migration (should the denser surface layer crack or be otherwise compromised) by self-bonding when exposed to a molten metal front.

The rammed refractory design described above has been somewhat successful in preventing metal migration in conventional coreless induction furnaces. For example, a 22 inch diameter coreless induction furnace processing gray iron for about 6 months at 1520° C. typically shows iron migration extending about one-quarter of the way into its four inch refractory layer. When the migration penetrates about half of the refractory layer, the refractory layer is typically replaced.

Although this conventional furnace has been somewhat successful in retarding leaks from conventional coreless induction furnaces, the performance requirements of induction furnaces are now becoming increasingly more ambitious. In particular, the furnaces are operating at higher frequencies (1000 Hz vs 60 Hz) and higher temperatures (at least 2950° F. vs 2700° F.), resulting in more severe conditions. Accordingly, these new operating conditions require reconsideration of the protection provided by the conventional refractory layer of coreless induction furnaces.

U.S. Pat. No. 5,134,629 discloses a "core and coil" induction furnace whose refractory barrier includes a flame-sprayed ceramic coating. U.S. Pat. No. 3,914,527 discloses a "core and coil" induction furnace whose refractory barrier includes fused silica. EPO Patent Publication 0 069 094 A1 discloses a "core and coil" induction furnace whose refractory barrier includes a sprayed, cast or brushed-on refractory layer. However, merely borrowing refractory designs from these conventional "core and coil" induction furnaces is considered to be of little value, since the "core and coil" induction furnace operates under relatively mild conditions (i.e, frequencies of 60 Hz and temperatures of 2750° F.) in comparison to the newer, high frequency coreless induction furnaces.

One particular concern related to the new operating conditions in a coreless furnace is that the higher frequencies generate a magnetic field which is not only stronger, but is also situated closer to the protective refractory layer. Accordingly, when molten metal penetrates the refractory, it moves towards the coil and in so doing enters into an even stronger portion of the magnetic field. The stronger magnetic field heats the stray metal to even higher temperatures, thereby facilitating its migration through the refractory. In a worse case scenario, the metal gets hotter and migrates farther until it finally reaches the cooling water surrounding the coil. When the 2750° F. metal contacts the water, it dissociates the water into hydrogen and oxygen which upon recombination cause violent and catastrophic explosion.

Accordingly, there is a need for a coreless induction furnace having a protective refractory layer which will resist molten metal penetration even under modern operating conditions.

SUMMARY OF THE INVENTION

In accordance with the present invention, there is provided a refractory lining for use in a coreless induction furnace having a refractory crucible, wherein the refractory lining lines the inner surface of the refractory crucible and has a porosity of between 0.2% and 1%.

Also in accordance with the present invention, there is provided a coreless induction furnace for processing a metal charge comprising:

a) an outer casing comprising a helical coil, and b) an inner crucible comprising:

i) an outer refractory layer having a porosity of at least about 10%, and ii) an inner refractory lining having a porosity of between 0.2% and 1%.

DETAILED DESCRIPTION OF THE INVENTION

It has been found that providing a refractory lining having a porosity of between 0.2% and 1% between the molten metal and the conventional rammed refractory layer of a coreless induction furnace enhances the resistance of a coreless induction furnace against molten metal penetration.

In preferred embodiments, the lining of the present invention is produced by flame spraying or plasma spraying a ceramic rod to produce a molten ceramic. When solidified, the molten ceramic provides a preferred lining which is superior to the conventional refractory layers for at least three reasons.

First, a flame or plasma sprayed ceramic lining generally has a porosity of only between about 0.2% and 1.0%, often about 0.5%. In contrast, the conventional rammed refractory layer has a porosity of about 18%, while the conventional layer of rammed refractory which bonds during the start up process ("the bonded layer") has a porosity of only about 10%. The decreased porosity of this preferred lining may provide a substantial physical barrier to metal migration.

Second, a ceramic plasma or flame sprayed coating typically has a pore size of only about 1 to 10 angstroms, often about 5 angstroms. In contrast, the conventional rammed layer has a pore size of about 12 um while the conventional bonded layer has a pore size of about 8 um. The decreased pore size of the preferred lining of the present invention may provide a substantially larger capillary drag which serves to decrease permeability so as to resist wetting and molten metal penetration.

Third, it is believed that molten metal reaction with relatively stable binary rammed refractory compositions creates relatively unstable ternary compounds. In contrast, flame or plasma sprayed coatings are generally unitary (i.e, one of alumina, chromia, zirconia or magnesia). Upon subsequent reaction of these preferred linings with molten metal, the resultant compound is merely binary and therefore relatively stable. Accordingly, it is believed that the single phase nature of the preferred linings contributes to their molten metal resistance.

Figure 1:
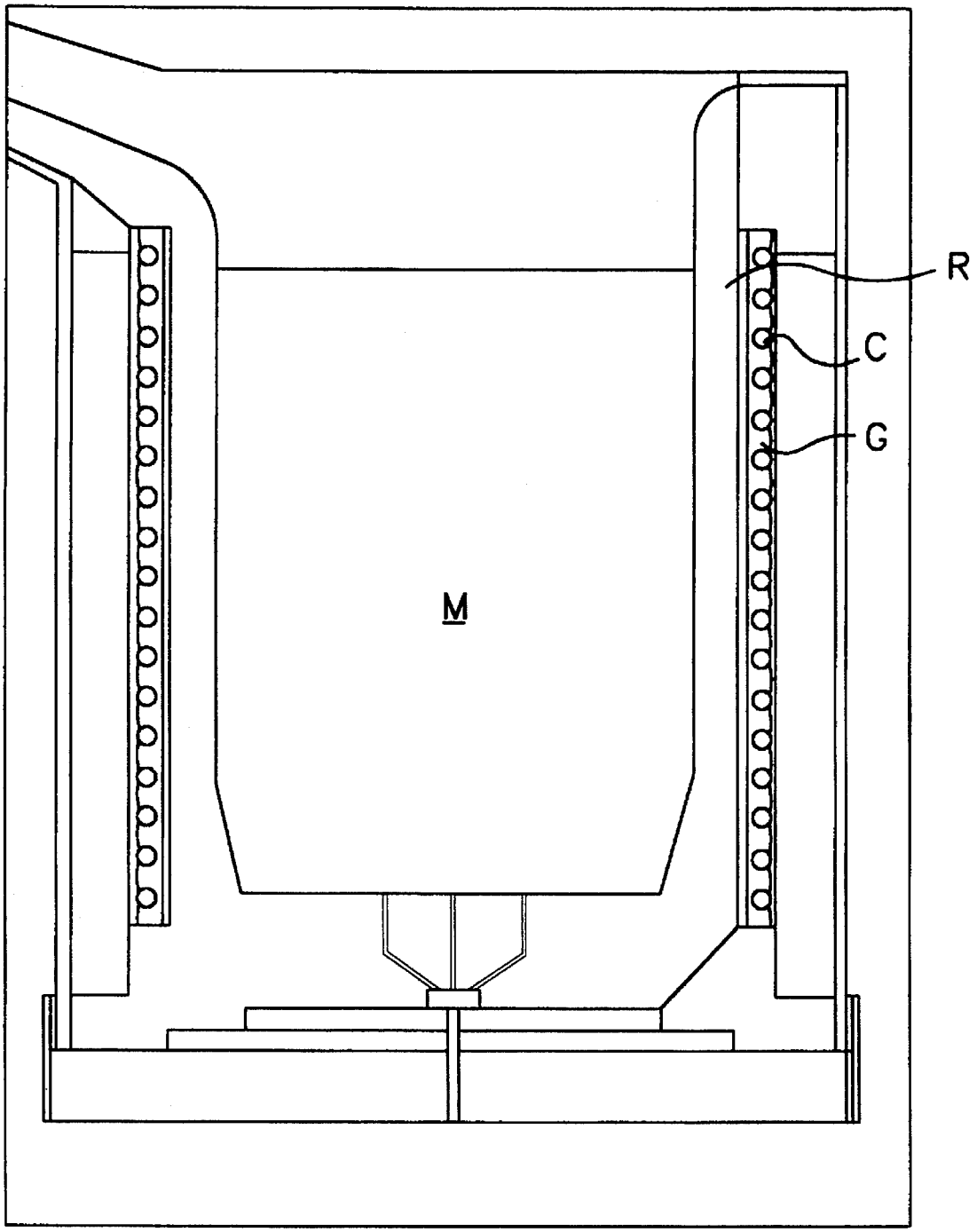
FIG. 1 PRIOR ART
FIG. 1 is a drawing of a cross section of a conventional coreless induction furnace.
Figure 2:
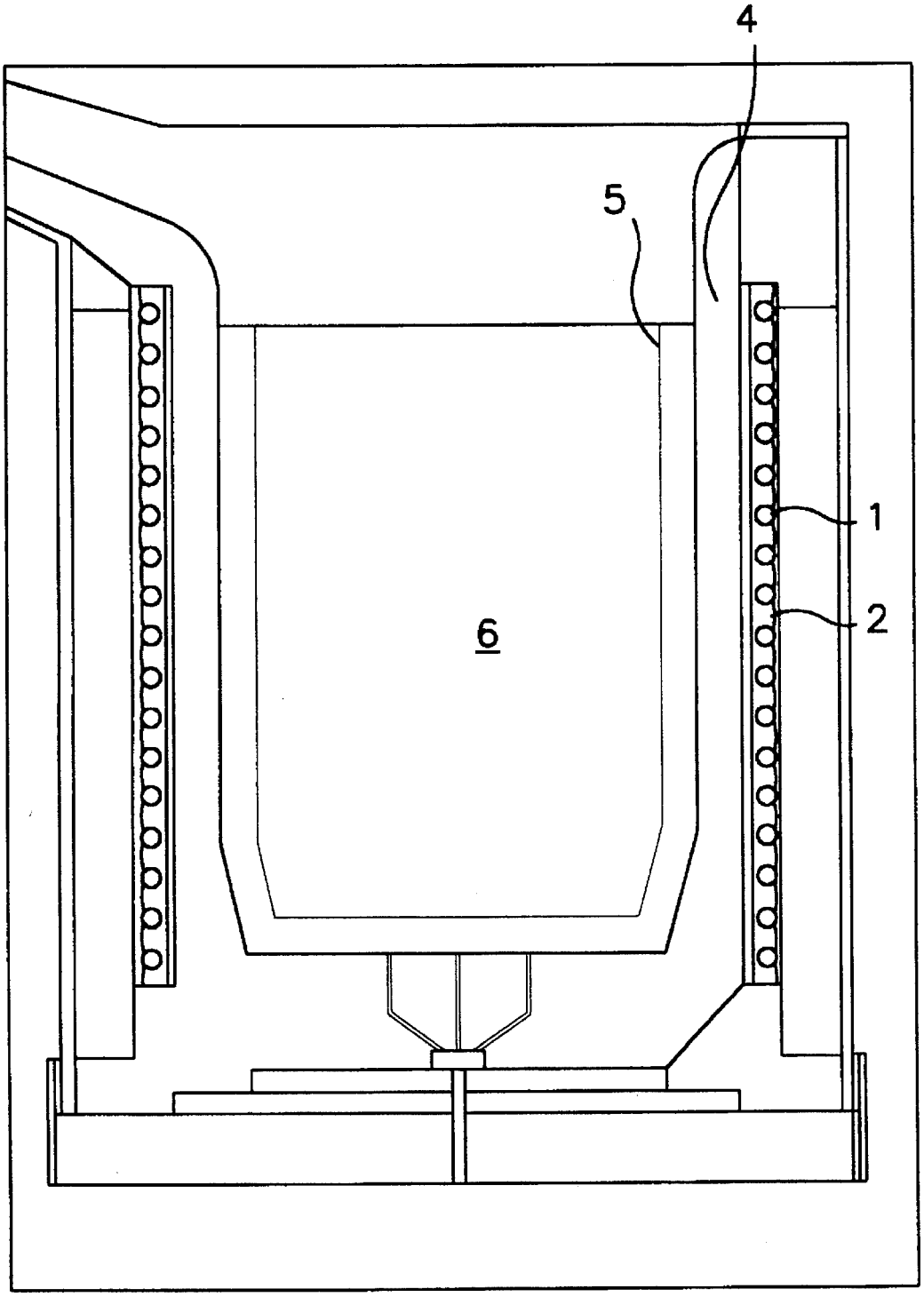
FIG. 2 is a drawing of a cross section of a coreless induction furnace of the present invention.

A cross section of a preferred cylindrical embodiment of the coreless induction furnace of the present invention is shown in FIG. 2. The outermost region of the furnace includes a steel shell. Directly inside the walls of the steel shell is an helix-shaped electrical coil 1 capable of providing an alternating frequency current. Typically surrounded by a water-cooled plastic housing (not shown), the coil is maintained in place by a refractory ceramic grout 2. The grout is bounded on the outside by the steel shell and on the inside by ceramic fiber paper. Proceeding inward of the ceramic fiber paper, there are, sequentially, rammed refractory grains 4, dense refractory (or "ceramic") lining 5, and metal charge 6.

In one preferred method of making the present invention, the dense ceramic lining is not created insitu, but rather is delivered in a molten state to the surface of a former having a shape identical to the shape of the metal charge to be melted, commonly a vertical cylinder. The dense ceramic lining can be so delivered by any known method, including flame spray coating, as taught in U.S. Pat. No. 5,134,629 (the specification of which is incorporated by reference), or by any known plasma-spray process. The former can be made of any material which can accept a molten ceramic and retain its shape, including iron, steel, copper, and aluminum alloys. When the molten ceramic cools and fuses, it has the shape of the former surface, and has the porosity and pore size characteristics described above.

Next, the former is positioned in the middle of a cylindrical cavity defined by a helical electrical coil surrounded by ceramic grout. However, the dimensions of the outside diameter of the former and the inside diameter of the grout are such that a space of between about 2.5 and 6 inches is produced therebetween. This space is filled with dry refractory grains which are then rammed by conventional means to produce the outer refractory region having a porosity of between about 10% and about 20%.

Next, the former is removed by melting. If the former is made of the metal to be melted, it is removed by simply starting up the induction furnace. Upon start-up, some of the heat provided by the initial melting cycle is conducted towards the dense ceramic lining and the rammed refractory grains. This heat causes the innermost rammed grains to at least partially sinter and bond to the dense ceramic lining. The end result is that the lining of the present invention is secured on the interior surface of the porous refractory grains.

The lining of the present invention has a porosity of between 0.2% and 1.0%, more often between 0.4% and 0.6%. Its median pore size is typically between 1 and 10 angstroms, more often between 2 and 6 angstroms. It typically has a thickness of between 0.007" and 0.018", often between 0.012" and 0.015". Although binary compounds such as spinel can be used as the inner dense refractory lining, it is preferred that this lining consist of a single ceramic compound, preferably a single ceramic oxide, more preferably one of alumina, chromia, zirconia, or magnesia. The dense ceramic lining can be applied by any known method of making molten ceramics, including flame spray coating as taught in U.S. Pat. No. 4,325,512 (the specification of which is incorporated by reference), or by any known plasma-spray process.

The outer refractory layer having a porosity of at least 10% can be made from any refractory grain mix commonly used in induction furnaces, including mullite-bonded alumina, spinel-bonded alumina, chromia-bonded alumina and spinel-bonded magnesia. It can be formed by any conventional process, including ramming, tamping, dry vibration and spray-slurrying. The grain size of these mixes is typically bimodal and comprises coarse grains between about 2.3 and 4.7 mm, and fine grains between 20 and 45 um in diameter. This layer typically has a porosity of between 10% and 20%, usually around 18%. Its median pore size is typically between 8 and 18 um, often between 8 and 12 um. Although its thickness is critically dependent upon furnace design, it typically has a thickness of between 5 cm and 15 cm.

The helical coil of the present invention may consist of any metal tubing commonly used in coreless induction furnaces, including copper tubing. Although the diameter of the coil is determined by the furnace manufacturer's design and will vary with furnace size and frequency, it is generally between 3 meters (m) and 10 m, preferably between about 3 m and 5 m. Similarly, the diameter of the tubing is determined by the furnace manufacturer's design and will vary with furnace size and frequency, and is generally between 5 cm and 15 cm, preferably between about 5 cm and 10 cm. In certain high frequency applications, the coil produces a frequency of between 240 Hz and 3000 Hz.

The grout which encases the helical coil can be any typical grout used in the art to support coils in coreless induction furnaces. Suitable materials include silica and alumina. Typical grain sizes are no more than 8 mesh (2.36 mm). Typical grout porosities are between 8% and 20%.

The metal processed in accordance with the present invention can be any metal typically processed in a coreless induction furnace, including copper, steel, iron and aluminum alloys. During processing, the temperature of the metal charge is typically between 2200° F. and 3300° F. The dimensions of the solid metal charge are usually a height of between 1 m and 5 m and a diameter of between 1 m and 3 m.

I claim:

1. A coreless induction furnace for processing a metal charge comprising:

a) an outer casing comprising a helical coil, and b) an inner crucible comprising:

i) an outer refractory layer having a porosity of at least about 10%, and ii) an inner refractory lining having a porosity of between 0.2% and 1%.

2. The furnace of claim 1 wherein the inner refractory lining has a mean pore size of between 1 and 10 angstroms.

3. The furnace of claim 2 wherein the inner refractory lining consists of a single ceramic compound.

4. The furnace of claim 3 wherein the single ceramic compound is an oxide ceramic.

5. The furnace of claim 4 wherein the oxide ceramic is selected from the group consisting of alumina, chromia, zirconia and magnesia.

6. The furnace of claim 2 wherein the inner refractory lining has a thickness of between 0.007 and 0.018 inches.

7. The furnace of claim 6 wherein the inner refractory lining has a thickness of between 0.012 and 0.015 inches.

8. The furnace of claim 2 wherein the inner refractory lining is flame-sprayed.

9. The furnace of claim 2 wherein the inner refractory lining is plasma-sprayed.

10. The furnace of 2 wherein the coil carries a current having a frequency of between 240 Hz and 3000 Hz.

11. The furnace of claim 10 wherein the metal charge has a temperature of between 2200° F. and 3300° F.

12. The furnace of claim 10 wherein the metal charge is selected from the group consisting of copper, iron, steel and aluminum alloys.

13. The furnace of claim 2 wherein the outer refractory layer has a thickness of between 5 and 15 cm.

14. The furnace of claim 2 wherein the outer refractory layer is selected from the group consisting of mullite-bonded alumina, spinel-bonded alumina, chromia-bonded alumina and spinel-bonded magnesia.

15. A process for producing a coreless induction furnace comprising the steps of:

a) flame spraying a molten ceramic material onto a former to provide a dense refractory lining having a porosity of between 0.2% and 1.0%, b) positioning the former within an outer casing to define a space therebetween, c) filling the space with refectory grain, d) ramming the refractory grain to provide an outer rammed refractory layer having a porosity of at least about 10%, and e) removing the former.

16. A process for processing metal comprising:

a) filling a coreless induction furnace comprising:

a) an outer casing comprising a helical coil, and b) an inner crucible comprising:

i) an outer refractory layer having a porosity of at least about 10%, and ii) an inner refractory lining having a porosity of between 0.2% and 1%, with a solid metal charge, and b) electrifying the helical coil with a current having a frequency of between 240 Hz and 3000 Hz.

* * * * *